US009228143B2

(12) United States Patent
Haube et al.

(10) Patent No.: US 9,228,143 B2
(45) Date of Patent: Jan. 5, 2016

(54) GASIFIER FOR SOLID CARBON FUEL

(71) Applicant: Xylowatt S.A., Charleroi (BE)

(72) Inventors: Michael Haube, Vezin (BE); Johan Klein, Kortenberg (BE); Frederic Bourgois, Ottignies (BE); Alexandre Bacq, Auderghem (BE)

(73) Assignee: Xylowatt S.A., Charleroi (BE)

( * ) Notice: Subject to any disclaimer, the term of this patent is extended or adjusted under 35 U.S.C. 154(b) by 226 days.

(21) Appl. No.: 14/138,586

(22) Filed: Dec. 23, 2013

(65) Prior Publication Data

US 2014/0102000 A1 Apr. 17, 2014

Related U.S. Application Data

(63) Continuation of application No. PCT/EP2012/062060, filed on Jun. 22, 2012.

(30) Foreign Application Priority Data

Jun. 23, 2011 (EP) ..... 11171156

(51) Int. Cl.
*B01J 7/00* (2006.01)
*C10J 3/52* (2006.01)
(Continued)

(52) U.S. Cl.
CPC .... *C10J 3/52* (2013.01); *C10J 3/02* (2013.01); *C10J 3/26* (2013.01); *C10J 3/28* (2013.01);
(Continued)

(58) Field of Classification Search
CPC ..... C10J 2300/0953; C10J 2300/0956; C10J 2300/0959; C10J 2300/0963; C10J 2300/0966; C10J 2300/0969; C10J 2300/0973; F23G 2201/30; F23G 2201/301; F23G 2201/302; F23G 2201/303; F23G 2201/304; F23G 5/24; F23G 5/245; F23G 5/26
See application file for complete search history.

(56) References Cited

U.S. PATENT DOCUMENTS 4,156,394 A * 5/1979 Mallek et al. ..... 110/346
4,336,131 A * 6/1982 Schmidt et al. ..... 209/3
(Continued)

FOREIGN PATENT DOCUMENTS

EP 101143 2/1984
EP 1248828 7/2001
(Continued)

OTHER PUBLICATIONS

International Search Report, issued by the International Searching Authority in connection with corresponding International patent application No. PCT/EP2012/062060, mailed on Sep. 6, 2012, 4 pages.
(Continued)

*Primary Examiner* — Imran Akram
(74) *Attorney, Agent, or Firm* — Hanley, Flight & Zimmerman, LLC

(57) ABSTRACT

Gasifiers for the gasification of solid carbon-based fuels are disclosed herein. An example gasifier includes an inlet chamber for introducing fuel into the gasifier and a pyrolysis region for pyrolyzing the fuel introduced into the vessel. The pyrolysis region includes first means for admission of a pyrolysis agent. The example gasifier also includes a combustion region for incinerating pyrolysis gases originating from the pyrolysis region, where the combustion region includes second means for admission of a gasifying agent. Also, the example gasifier includes a reduction region for gasifying carbonized fuel originating from the pyrolysis region, an outlet for collecting gases originating from the reduction region, and a region for collecting and discharging ashes. In addition, the example gasifier includes active transfer means to actively transfer solid material from the pyrolysis region to the reduction region. In some examples, the active transfer means is located between the pyrolysis region and the combustion region, and the active transfer means includes a transfer chamber to prevent a direct flow of the solid material from the pyrolysis region to the reduction region, where the transfer chamber is permeable to the pyrolysis gases.

9 Claims, 3 Drawing Sheets

(51) Int. Cl.

| | |
|---|---|
| ***C10J 3/02*** | (2006.01) |
| ***C10J 3/26*** | (2006.01) |
| ***C10J 3/28*** | (2006.01) |
| ***C10J 3/30*** | (2006.01) |
| ***C10J 3/40*** | (2006.01) |
| ***C10J 3/42*** | (2006.01) |
| ***C10J 3/66*** | (2006.01) |
| ***C10J 3/32*** | (2006.01) |
| ***C10J 3/72*** | (2006.01) |

(52) U.S. Cl.

CPC .... *C10J 3/30* (2013.01); *C10J 3/32* (2013.01); *C10J 3/40* (2013.01); *C10J 3/42* (2013.01); *C10J 3/66* (2013.01); *C10J 3/723* (2013.01); *C10J 2200/158* (2013.01)

(56) References Cited

U.S. PATENT DOCUMENTS

| | | | | |
|---|---|---|---|---|
| 4,530,702 | A * | 7/1985 | Fetters et al. | 48/209 |
| 5,588,381 | A * | 12/1996 | Jennebach et al. | 110/345 |
| 2002/0069798 | A1* | 6/2002 | Aguadas Ellis | 110/229 |
| 2002/0095866 | A1* | 7/2002 | Hassett | 48/199 FM |
| 2004/0050307 | A1* | 3/2004 | Gnedenko et al. | 110/346 |
| 2005/0109603 | A1* | 5/2005 | Graham | 201/25 |
| 2007/0234937 | A1* | 10/2007 | Guyomarc'h | 110/248 |
| 2010/0270506 | A1* | 10/2010 | Goetsch et al. | 252/373 |
| 2011/0078951 | A1* | 4/2011 | Blasiak et al. | 48/63 |
| 2011/0081290 | A1* | 4/2011 | Carnegie | 423/651 |
| 2011/0088321 | A1* | 4/2011 | Kim | 48/89 |

FOREIGN PATENT DOCUMENTS

| | | |
|---|---|---|
| GB | 2290858 | 1/1996 |
| NL | 8200417 | 9/1983 |
| WO | 0151591 | 7/2001 |
| WO | 2008107727 | 9/2008 |

OTHER PUBLICATIONS

International Search Report, English translation, issued by the International Searching Authority in connection with corresponding International patent application No. PCT/EP2012/062060, mailed on Sep. 6, 2012, 3 pages.

International Preliminary Report on Patentability and Written Opinion, issued by the International Searching Authority in connection with corresponding International patent application No. PCT/EP2012/062060, mailed on Jan. 9, 2014, 7 pages.

International Preliminary Report on Patentability and Written Opinion, English translation, issued by the International Searching Authority in connection with corresponding International patent application No. PCT/EP2012/062060, mailed on Jan. 9, 2014, 7 pages.

* cited by examiner

GASIFIER FOR SOLID CARBON FUEL

RELATED APPLICATIONS

This patent is a continuation of International Patent Application Serial No. PCT/EP2012/062060, filed on Jun. 22, 2012, which claims priority to European Patent Application 11171156.0, filed on Jun. 23, 2011, both of which are hereby incorporated herein by reference in their entireties.

TECHNICAL FIELD

This disclosure relates generally to gasifiers and, more specifically to a cocurrent fixed bed gasifier for the gasification of a solid carbon-based fuel, such as, for example, solid biomass.

BACKGROUND

Known gasifiers make it possible to produce a fuel gas from a solid carbon-based fuel, in particular from wood waste, such as that originating, for example, from saw mills or from forestry, or from agricultural byproducts (straw, and the like), or also from recycled wood. This fuel gas comprises in particular carbon monoxide and hydrogen and can subsequently be used for various purposes, such as, for example, to feed a gas turbine or an internal combustion engine, a boiler, or a furnace.

However, the majority of known cocurrent gasifiers provide a gas also comprising a not insignificant amount of tars, which can harm the satisfactory operation of the equipment in which such a gas is used as fuel. Various solutions have thus been provided in order to reduce the content of tars of the gas produced by such gasifiers.

European Patent EP 1 248 828 discloses, for example, a gasifier in which an empty space (that is to say, a region devoid of solid material) is created in the combustion region in order to obtain better combustion of the pyrolysis gases and also better gasification of the pyrolyzed mass, which makes it possible to reduce the content of tars of the gas at the outlet. In order to create this empty space, this patent proposes to equip the lower part of the reduction region with a mechanism that makes it possible to regulate the transfer of solid material between the reduction region and the region for collecting the ashes.

The lower part of the pyrolysis region is furthermore equipped with funnels and with a movable grid in order to more or less meter out the amount of solid fuel entering the combustion region.

Such a system exhibits the disadvantage that, in view of the highly random nature of the flows of solids, it is possible for material not yet completely pyrolyzed to enter the combustion region. Furthermore, it might also possibly be that material not yet completely reduced enters the region for collecting the ashes. This is because, in the case where the flow rate of material entering the combustion region is faster than anticipated, the means for transferring material to the region for collecting the ashes will open to a greater extent in order to maintain the empty space in the combustion region. In fact, this incoming flow rate can vary according to circumstances, for example as a function of the physical characteristics of the biomass used (for example particle size measurement) and/or of the momentary characteristics of the flow.

Dutch Patent NL-8200417 discloses a similar gasifier and proposes to equip the lower part of the pyrolysis region with a mechanism which makes it possible to transfer solid material from the pyrolysis region to the reduction region while leaving an empty space between these two regions. This solid material transfer mechanism comprises a cone placed at a distance from a corresponding conical narrowing of the vessel and which can be rotated and/or axially moved in order to stir the solid material in order thus to transfer it to the reduction region. Here again, in the light of the highly random nature of the flows of the solids, it is possible for fuel which has not yet been completely pyrolyzed to enter the combustion region. As for the preceding example, "chimney" and/or "avalanche" phenomena (reference was made to the nature of the solid flow) can, for example, appear in the pyrolysis region. If appropriate, solid material freshly introduced into the vessel (and thus not yet completely pyrolyzed) might be carried to the reduction region by the transfer mechanism, which will bring about an increase in the content of tars of the gas at the outlet.

Although very different in their structure and their operation, there also exist countercurrent gasifiers, such as that described in the International Patent Publication WO 2008/107727 and which also involves a movable grid in order more or less to meter out the solid material entering the reduction region. Such a movable grid exhibits the same disadvantages as those described above.

SUMMARY

One aim of the teachings of the present disclosure is to at least partially solve the problems of the known gasifiers.

To this end, the example gasifier according to the teachings of this disclosure include active transfer means that comprise a transfer chamber capable of preventing a direct flow of the solid material from the pyrolysis region to the reduction region, the transfer chamber being permeable to the pyrolysis gases.

This is because, by virtue of such a transfer chamber, it becomes possible to exert better control over the transfer of solid material to the reduction region and thus to reduce the amount of fuel not yet completely pyrolyzed entering the reduction region, which contributes to reducing the amount of tars in the outlet gases. A transfer chamber also makes it possible to have better regulation of the flow rate of solid material poured into the reduction region and thus to better ensure an empty space (that is to say, a region devoid of solid material) above the reduction region, which also contributes to reducing the amount of tars in the outlet gases.

In some examples disclosed herein, the transfer chamber comprises a first rotating plate comprising at least one first off-centered opening and a second rotating plate comprising at least one second off-centered opening, the two plates being positioned horizontally and at a distance from one another, thus defining a transfer region between the two plates, each of the first openings being offset horizontally with respect to each of the second openings, and the transfer region is equipped with a first obstacle which is fixed with respect to the vessel.

In addition to the abovementioned advantages, such example device makes it possible, by virtue of the off-centering and the rotating movement of the first opening, to achieve a better distribution of the withdrawal of solid fuel from the pyrolysis region. This device, thus, makes it possible to achieve a better approximation to an ideal flow of the LILO (Last In Last Out) type of the solid material in the pyrolysis region and it, thus, contributes to rendering the pyrolysis even more complete.

Furthermore, by virtue of the off-centering and the rotating movement of the second opening, this example device makes it possible to distribute the solid material more uniformly over the bed of material in the reduction region, which contributes to a better gasification. This is because a more uniform distribution makes it possible to prevent preferred pathways for the gas stream through the reduction region, which pathways would otherwise give rise to a reduced completion of the reduction reactions between solid particles and gas streams by an excessively rapid passage of said gas streams through the reduction bed.

The two abovementioned effects contribute to reducing even more the amount of tars in the outlet gases.

It should be noted that, as the first obstacle is fixed with respect to the vessel, this has the effect of preventing at least a portion of the solid material from being carried along in rotation by the rotation in the first and/or second plate, which makes possible effective emptying of the transfer region through the second opening.

In some examples, the first rotating plate is surmounted by a second obstacle which is fixed with respect to the vessel, in order to prevent at least a portion of the solid material located in the pyrolysis region from being carried away in rotation by the rotation of the first plate, which would otherwise disrupt the flow as desired of the material in the pyrolysis region.

BRIEF DESCRIPTION OF THE FIGURES

These aspects and other aspects of the disclosure will be clarified in the detailed description of specific examples disclosed herein, reference being made to the drawings of the figures, in which.

The drawings of the figures are not to scale. Generally, similar components are denoted by similar references in the figures.

DETAILED DESCRIPTION

Disclosed herein are example gasifiers that include a vertical vessel. In some examples, the gasifier includes, successively from the top downward:

a. an inlet chamber for introducing the fuel into the vessel,
b. a pyrolysis region for pyrolyzing the fuel introduced into the vessel and comprising first means for admission of a pyrolysis agent,
c. a combustion region for incinerating pyrolysis gases originating from the pyrolysis region and comprising second means for admission of a gasifying agent,
d. a reduction region for gasifying carbonized fuel originating from the pyrolysis region,
e. an outlet for collecting gases originating from the reduction region, and
f. a region for collecting and discharging ashes.

Furthermore, the example vessel includes active transfer means for actively transferring solid material from the pyrolysis region to the reduction region. In some examples, the active transfer means are located between the pyrolysis region and the combustion region. In other words, the active transfer means are located in the vessel between the point where the first means for admission of the pyrolysis agent are provided in order to admit the pyrolysis agent into the vessel and the point where the second means for admission of the gasifying agent are provided in order to admit the gasifying agent into the vessel.

The term "pyrolysis agent" should be understood as meaning a neutral or reactive gas which will contribute the energy for the rise in temperature of the solid fuel present in the pyrolysis region. This energy can either be conveyed by the gas itself or be generated by the reaction of gas with the products present in the pyrolysis region. The pyrolysis agent can thus, for example, be preheated ambient air, a gas having a higher concentration of oxygen, steam, carbon dioxide, a fuel gas or also a mixture of these gases.

The term "gasifying agent" should be understood as meaning a gas capable of reacting with the carbon and/or with the hydrogen present in the solid fuel. The gasifying agent can thus, for example, be ambient air, a gas having a higher concentration of oxygen, steam, carbon dioxide or also a mixture of these gases.

The disclosure also relates to a unit for the production and combustion of gas comprising such a gasifier in order to produce the gas.

The examples disclosed herein use solid biomass as example fuel but, in some examples, any other type of solid carbon-based fuel will also be suitable.

Figure 1:
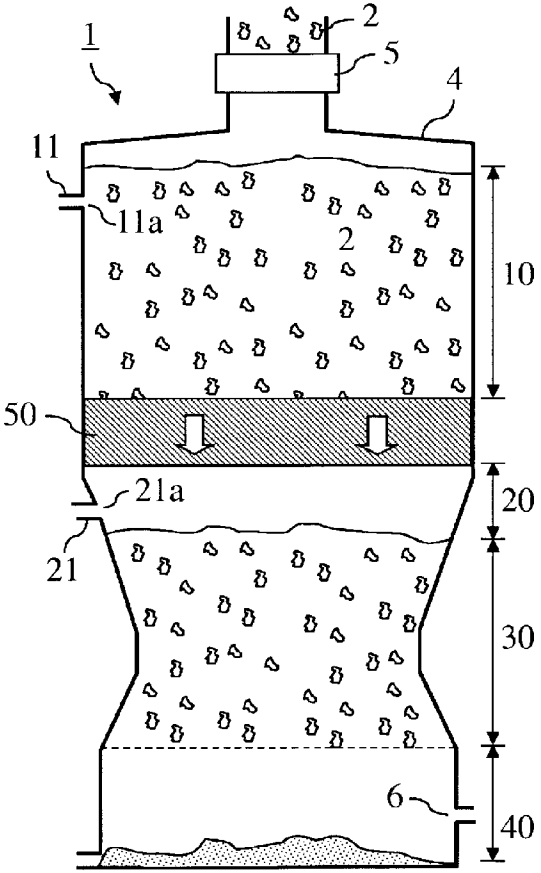
FIG. 1 diagrammatically shows a frontal cross section of an example gasifier according to the teachings of this disclosure.

FIG. 1 diagrammatically shows a frontal cross section of an example gasifier (1) according to the teachings of this disclosure. This example gasifier is formed by a reactor in the form of a vertical vessel (4) successively comprising, from the top downward:

a. an inlet chamber (5) for introducing biomass (2) into the vessel,
b. a pyrolysis region (10) for pyrolyzing the biomass introduced into the vessel and comprising first means for admission of a pyrolysis agent (11),
c. a combustion region (20) for incinerating pyrolysis gases originating from the pyrolysis region and comprising second means for admission of a gasifying agent (21),
d. a reduction region (30) for gasifying carbonized biomass originating from the pyrolysis region,
e. an outlet (6) for collecting gases originating from the reduction region, and
f. a region (40) for collecting and discharging ashes.

The biomass (2), for example wood chips, is introduced into the vessel (4) via the top by means of the inlet chamber (5) (for example a rotating valve) and thus enters the pyrolysis region (10), where the biomass (2) is decomposed under the effect of the heat to give volatile materials and a solid carbon-rich residue generally called char or coke. This reaction typically takes place within a temperature range between 300° C. and 700° C.

The first means for admission of a pyrolysis agent (11)—for example one or more nozzle(s) emerging laterally in the vessel at the level of the pyrolysis region—make it possible to introduce therein a gas that will directly or indirectly contribute energy for the partial or complete decomposition of the biomass to give volatile materials and char. The gas can, for example, be a reactive gas comprising oxygen which, on incinerating a fraction of the biomass or of the products from the decomposition of the biomass, will give off energy for the pyrolysis. It can also be an inert gas (such as carbon dioxide, nitrogen or steam) which, preheated, will contribute energy for the pyrolysis. It can also be a combination of both these types of gas. Other types of means for admission of the pyrolysis agent are, of course, possible, such as, for example, a nozzle vertically dipping into the vessel and emerging in the pyrolysis region.

The vessel also comprises active transfer means for actively transferring solid material (e.g., char) from the pyrolysis region (10) to the reduction region (30). The example transfer means is located between the pyrolysis region (10) and the combustion region (20). In other words, the active transfer means are located in the vessel between the point (11*a*) where the first means (11) for admission of the pyrolysis agent are provided in order to admit the pyrolysis agent into the vessel and the point (21*a*) where the second means (21) for admission of the gasifying agent are provided in order to admit the gasifying agent into the vessel.

The example active transfer means comprise a transfer chamber (50) capable of preventing a direct flow of the solid material (2) from the pyrolysis region (10) to the combustion region (20).

The example transfer means thus have a twofold function: on the one hand, the example transfer means provide a physical separation for the solid material (2) between the pyrolysis region (10) and the remainder of the reactor (regions 20, 30 and 40) and, on the other hand, the example transfer means make it possible to actively control the flow of solid material (2) between these two parts of the reactor (4). It should be noted that the example transfer means make possible the passage of the volatile materials from the pyrolysis region to the combustion region in order to be incinerated therein. In other words, the transfer chamber is permeable to the pyrolysis gases.

Implementation of examples will be provided below.

The volatile materials (also known as "pyrolysis gas") entering the combustion region (20) are partially or completely incinerated therein at the level of the second means for admission of a gasifying agent (21). These second means for admission of a gasifying agent can, for example, comprise a several nozzle(s) emerging laterally in the vessel at the level of the combustion region. This combustion produces carbon dioxide ($CO_2$), water ($H_2O$) and, of course, heat. Typically, temperatures of greater than 1100° C. are achievable in the combustion region.

The char which has been transferred into the reduction region will react with the combustion products to form in particular carbon monoxide (CO) and hydrogen ($H_2$).

In the case, for example, of an autothermal reaction of lignocellulose materials—such as wood—and of the use of ambient air at ambient temperature as gasifying agent, this reaction typically takes place within a temperature range of between 300° C. and 800° C. This temperature will nevertheless be able to be higher and to reach or even exceed 1300° C. in the case where a fuel richer in carbon is used and/or where preheated reactants are used.

The gases produced by this reaction will be collected at the outlet (6) of the reactor, which is located in the bottom of the vessel (4). Thus, at the outlet (6), a fuel gas is found, which typically comprises approximately 15% to 30% of CO, 10% to 25% of $H_2$, 0.5 to 3% of $CH_4$, 5% to 15% of $CO_2$ and 49% of $N_2$, when ambient air is used as gasifying agent.

The ashes will be collected in the base (40) of the vessel.

The transfer chamber device or chamber (50) of the example gasifiers disclosed herein are described in more detail and in alternative examples provided below.

Figure 2:
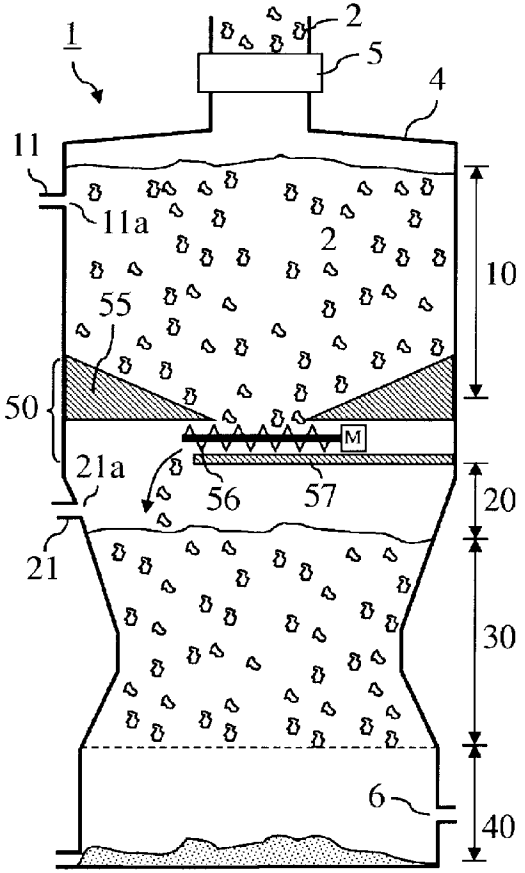
FIG. 2 shows a frontal cross section of another example gasifier according to the teachings of this disclosure.

FIG. 2 shows a frontal cross section of an example gasifier according to the teachings of this disclosure. The transfer chamber (50) in this example comprises a hopper (55) under which is fitted an endless screw (56) driven by a motor (M). In this example, the screw is surrounded by a cylindrical part (57) emerging in the combustion region.

The example transfer chamber thus makes it possible to actively transfer char from the pyrolysis region (10) to the reduction region (30) while preventing a direct flow of the char from the pyrolysis region to the reduction region. The flow rate of char will, for example, be able to be regulated by varying the speed of rotation of the motor (M). In particular, this flow rate will be regulated so as to continuously leave a void of solid material above the reduction region. Advantageously, the control of the speed of the motor (M) will be able to be carried out in a closed loop. Detectors of the presence of solid material in the combustion region can be used for this purpose.

Other mechanisms for material transfer can be envisaged, such as, for example, a transfer chamber comprising two sliding doors (for example, an inlet door directed toward the pyrolysis region and an outlet door directed toward the combustion region, the inlet door being open when the outlet door is closed and vice versa; it is also possible to envisage several inlet doors and several outlet doors), in which case the flow rate of char will be able to be regulated by varying the rhythms of opening and closing the inlet and outlet doors. It should be noted that the inlet and outlet doors may not be gastight as the transfer chamber has to be able to allow the pyrolysis gases to continuously pass.

In another example, the material transfer means comprise a transfer chamber, one inlet of which (pyrolysis region side) is formed by a plurality of transverse bars that are spaced out and parallel to one another. In this example, at least one of the bars is rotatable and has a polygonal cross section (for example, a square cross section). Also, in this example, an outlet of the transfer chamber (combustion region side) is formed by one or more movable shutters. The distance between two adjacent bars and their respective cross sections will be designed so that, in the absence of rotation of that/those of the bars which is/are rotary among the two adjacent bars, the solid material remains blocked above the two adjacent bars by an effect of an arch supported on the two adjacent bars. On setting in rotation those of the bars that are rotary while the movable shutter(s) is/are closed, solid material originating from the pyrolysis region will enter the transfer chamber without being able to exit therefrom. On subsequently halting the rotation of these bars and on opening thereafter the movable shutters, the solid material previously stored in the transfer chamber will be released to the reduction region. The movable shutters will be permeable to gases in order to make it possible in particular for the pyrolysis gases to freely pass through the transfer chamber, even if the movable shutters are closed. The flow rate of solid material can be controlled by varying the rhythm of the rotation/stopping rotation of the bars—opening/closing of the shutters sequences.

Figure 3:
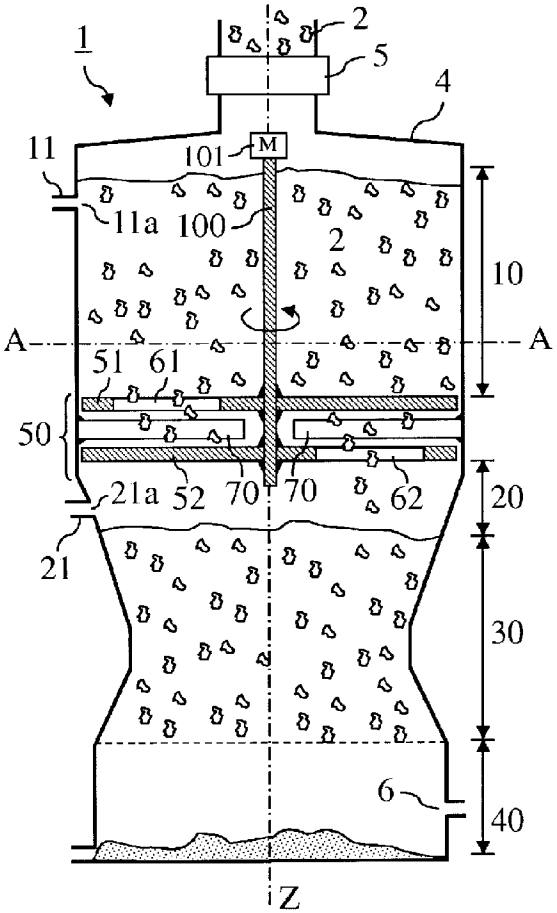
FIG. 3 shows a frontal cross section of yet another example gasifier according to the teachings of this disclosure.

FIG. 3 shows a frontal cross section of an example gasifier according to the teachings of this disclosure. The example transfer chamber (50) here comprises a first rotating plate (51) comprising at least one first opening (61) and a second rotating plate (52) comprising at least one second opening (62). The two plates are positioned horizontally and at a distance from one another, so as to form a transfer region between the two plates. The two plates, in this example, are connected to a vertical central shaft (100) having an axis Z that can be driven in rotation, for example by means of a motor (101).

The two openings (61, 62) are off-centered with respect to the Z axis, and the openings (61, 62) are also offset horizontally with respect to one another, so that the char (2) cannot pass directly from the pyrolysis region (10) to the reduction region (30). In other words, the first openings (61) of the first plate are designed in order not to overlap the second openings (62) of the second plate.

In some examples, the plates (51, 52) have a circular shape and the vessel (4) has a circular transverse cross section, the diameter of which at the level of the plates is slightly greater than the diameter of the plates.

The transfer region between the two plates is furthermore equipped with a first obstacle (70) which is fixed with respect to the vessel. It can, for example, be one or more transverse bar(s) attached directly or indirectly to the vessel (4). This obstacle makes it possible to prevent solid material from being carried away by the rotational movement of the second plate (52) and, thus, to force the material to pass through the second opening (62) when the material arrives opposite the second opening.

Figure 4:
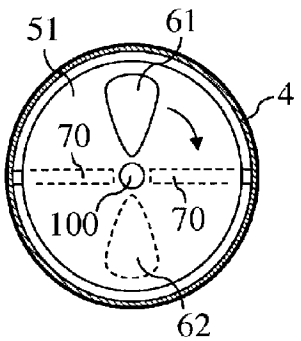
FIG. 4 shows a view in transverse cross section (AA) of the gasifier of FIG. 3.

FIG. 4 shows a view in transverse cross section (AA) of the example gasifier of FIG. 3. The two openings (61, 62) and the arrangement of the first fixed obstacle (70) are seen better therein. In some examples, the first fixed obstacle comprises at least one first fixed crossbeam extending radially with respect to the plates.

The motor (101) can have a continuous rotating movement or a clockwise-anticlockwise oscillating movement. In the case of a continuous rotating movement, the rotational speed of the motor will, for example, be of the order of 5 to 15 revolutions per hour. In some examples, the motor (101) will be subject to the demand for char in the reduction region (30) and so as to maintain a void above the bed of material in the reduction region. It is possible, for this purpose, to provide a high level sensor and a low level sensor for char in the reduction region and to control the motor (101) in order for the motor (101) to start rotating when a low level is detected and in order for the motor (101) to stop when a high level is detected.

Figure 5:
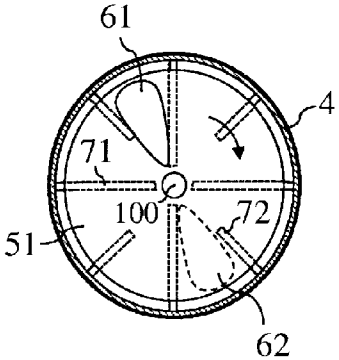
FIG. 5 shows another view in transverse cross section (AA) of the gasifier of FIG. 3.

FIG. 5 shows another view in transverse cross section (AA) of an example of the gasifier of FIG. 3. In the example of FIG. 5, the first fixed obstacle comprises at least one first fixed crossbeam (71) extending radially with respect to the plates and in addition at least one other crossbeam (72) offset angularly with respect to at least one first crossbeam (71) and extending partially radially, starting at the outside toward a center of the plates. In this example, the other crossbeam (72) extends over approximately half of a radius of a plate (51, 52). This other crossbeam (72) makes it possible to prevent material from accumulating directly above the first crossbeam (71) when the plates are in rotation, which would otherwise be harmful to a uniform distribution of the material in the reduction region, without, however, creating excessively small spaces in the central area of the transfer region, that is to say close to the central shaft (100). As is shown in the example of FIG. 5, there are four radial crossbeams (71) offset by 90° between one another and four partially radial crossbeams (72) offset by 90° between one another and also by 45° with respect to the radial crossbeams.

Figure 6:
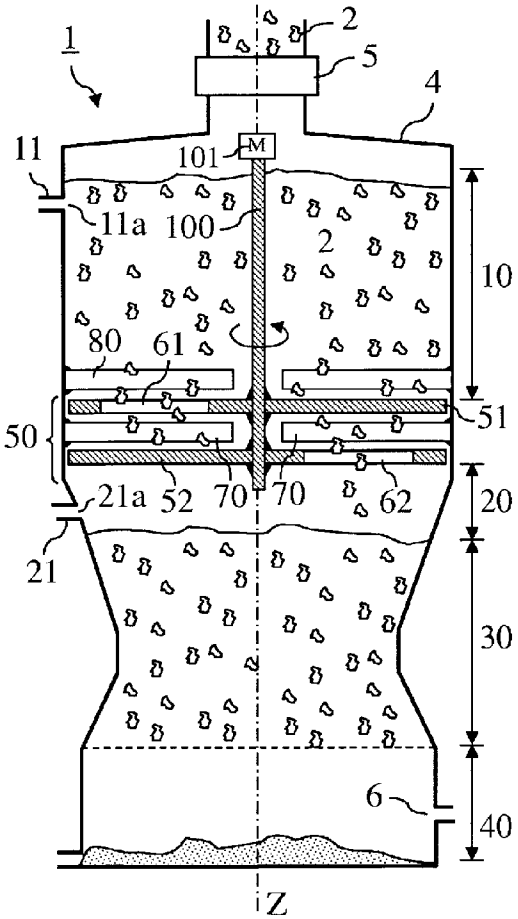
FIG. 6 shows a frontal cross section of the example gasifier of FIG. 3 with an example obstacle.

FIG. 6 shows a frontal cross section of another example of the gasifier according to FIG. 3. In this instance, the first plate (51) is surmounted by a second obstacle (80) which is fixed with respect to the vessel, such as a radial crossbeam, for example.

This second obstacle makes it possible to prevent solid material (2) occurring in the pyrolysis region (10) from being carried away in rotation by the rotational movement of the first plate (51) and, thus, to ensure a more homogeneous flow (LILO) of the material from the top downward.

In some examples, the second fixed obstacle is fitted so as to be aligned with respect to the first fixed obstacle in the direction of the vertical axis Z. Thus, if the first fixed obstacle comprises, for example, four radial crossbeams (71), as illustrated in FIG. 5, the second fixed obstacle, in some examples, also comprises four radial crossbeams vertically aligned with respect to the four radial crossbeams (71) of the first obstacle.

Figure 7:
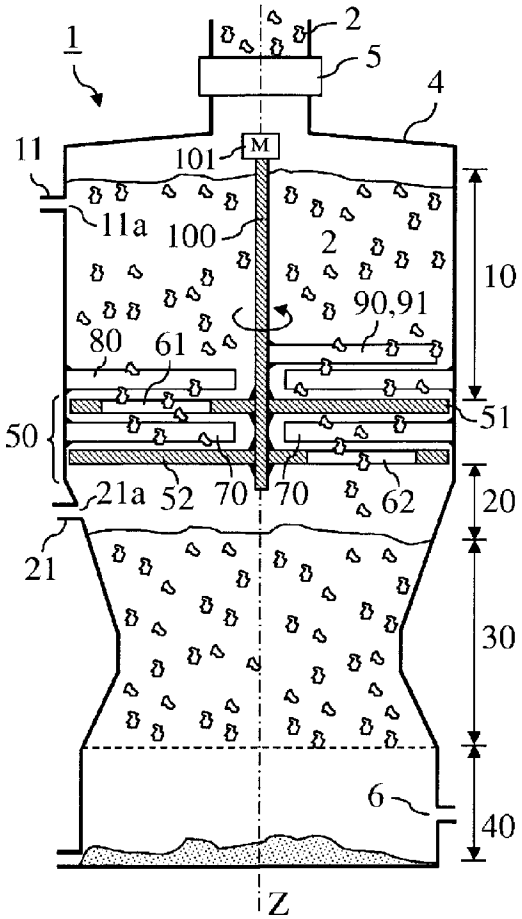
FIG. 7 shows a frontal cross section of the example gasifier of FIG. 3 with an example blade.

FIG. 7 shows a frontal cross section of another example of the gasifier according to FIG. 3. In this instance, the vessel (4) furthermore comprises shearing means (90) for shearing, in a transverse plane, the solid material (2) located in the pyrolysis region (10). In some examples, the shearing means (90) are located just above the second obstacle (80). The example shearing means make it possible to prevent arches of solid material (2) being formed in the pyrolysis region, by breaking the bases of these arches, which are generally supported on the second obstacle (80). This results in a more homogeneous flow ("LILO") of the material.

In some examples, the shearing means comprise a movable blade (91) extending substantially horizontally in the vessel (4). Also, in some examples, the blade (91) is fixed to the central shaft (100) so that the blade (91) can be driven in rotation by the central shaft (100). Alternatively, the blade (91) can be driven in rotation or in translation by appropriate driving means.

The disclosure also relates to a unit for the production and combustion of gas comprising a gasifier as disclosed above to produce the gas. It can, for example, be a combination comprising a gasifier as disclosed above and an internal combustion engine, the outlet (6) of the gasifier being connected to a fuel admission system of the engine.

The present disclosure has been described in connection with specific examples that have a purely illustrative value and should not be regarded as limiting. Generally, a person skilled in the art would understand that the present disclosure is not limited to the examples illustrated and/or described above. The presence of reference numbers in the drawings cannot be regarded as limiting, including when these numbers are shown in the claims. The use of the verbs "to comprise", "to include" or any other variant, and also their conjugations, cannot in any way exclude the presence of components other than those mentioned. The use of the indefinite article "a" or "an" or of the definite article "the" to introduce a component does not exclude the presence of a plurality of these components.

The disclosure can also be described as follows: a gasifier for solid carbon-based fuel comprising a vertical vessel (4), the vessel successively comprising, starting from the top downward: an inlet (5) for solid carbon-based fuel (2) to be gasified, a region for pyrolysis (10) of the fuel in order to produce pyrolysis gases and char, a region for combustion (20) of the pyrolysis gases, a region for reduction (30) of the char, an outlet (6) for gases and a region for collecting ashes (40). The pyrolysis region (10) is separated from the combustion region (20) by active transfer means comprising a transfer chamber (50) capable of transferring the fuel (2) from the pyrolysis region (10) to the reduction region (30) without the fuel being able to flow directly from the pyrolysis region (10) to the reduction region (30), thus making it possible to exert better control over the flow rate of solid material between these two regions.

Although certain example methods and apparatus have been disclosed herein, the scope of coverage of this patent is not limited thereto. On the contrary, this patent covers all methods, apparatus and articles of manufacture fairly falling within the scope of the appended claims either literally or under the doctrine of equivalents.

The invention claimed is:

1. A cocurrent fixed bed gasifier for the gasification of solid carbon-based fuel, the gasifier comprising a vertical vessel successively comprising, from the top downward:

an inlet chamber for introducing fuel into the gasifier;

a pyrolysis region for pyrolyzing the fuel introduced into the vessel, the pyrolysis region comprising first means for admission of a pyrolysis agent;

active transfer means to actively transfer solid material from the pyrolysis region to a reduction region, the active transfer means comprising a transfer chamber configured to prevent a direct flow of the solid material from the pyrolysis region to the reduction region, the transfer chamber being permeable to pyrolysis gases originating from the pyrolysis region, wherein the transfer chamber comprises:

a first rotatable plate comprising a first off-centered opening; and a second rotatable plate comprising a second off-centered opening, the first plate and second plate being positioned horizontally and spaced apart to define a transfer region between the first plate and the second plate, the first opening horizontally offset relative to the second opening, the transfer region being equipped with a first obstacle, the first obstacle being fixed with respect to the vessel;

a combustion region for incinerating the pyrolysis gases, the combustion region comprising second means for admission of a gasifying agent;

the reduction region for gasifying carbonized fuel originating from the pyrolysis region;

an outlet for collecting gases originating from the reduction region; and a region for collecting and discharging ashes.

2. The gasifier as claimed in claim 1, wherein the first obstacle comprises a first crossbeam extending radially with respect to the first plate and the second plate.

3. The gasifier as claimed in claim 2, wherein the first obstacle comprises a second crossbeam offset angularly with respect to the first crossbeam and extending partially radially from an outside toward a center of the first plate and the second plate.

4. The gasifier as claimed in claim 1, wherein the first plate is surmounted by a second obstacle, the second obstacle being fixed with respect to the vessel.

5. The gasifier as claimed in claim 4, wherein the second obstacle comprises a second crossbeam extending radially with respect to the first plate and the second plate.

6. The gasifier as claimed in claim 4 further comprising shearing means to shear, in a transversal plane, the solid material located above the second obstacle.

7. The gasifier as claimed in claim 6, wherein the shearing means comprises a movable blade extending substantially horizontally.

8. The gasifier as claimed in any of claims 1-7 further comprising:

a central shaft to which the first plate, the second plate and the blade are coupled; and means for driving the central shaft in rotation.

9. A unit for the production and combustion of gas comprising the gasifier of any of claims 1-7.

* * * * *